United States Patent [19]

Holtz, deceased et al.

[11] 4,249,912

[45] Feb. 10, 1981

[54] AMINOAMIDE FUEL DETERGENTS

[75] Inventors: Hans D. Holtz, deceased, late of Bartlesville, Okla., by Marilyn T. Holtz, executrix; Benedict R. Bonazza, Bartlesville, Okla.

[73] Assignee: Phillips Petroleum Company, Bartlesville, Okla.

[21] Appl. No.: 900,553

[22] Filed: Apr. 27, 1978

[51] Int. Cl.[3] ..... C10C 1/22; C10M 1/40; C10M 1/32

[52] U.S. Cl. ..... 44/71; 44/72; 252/33; 252/47.5; 252/51.5 A; 260/503

[58] Field of Search ..... 44/72, 71; 252/51.5 A, 252/47.5, 33; 260/504 R

[56] References Cited

U.S. PATENT DOCUMENTS

| | | | |
|---|---|---|---|
| 2,830,019 | 4/1958 | Fields et al. | 252/33.6 |
| 2,862,883 | 12/1958 | Hughes et al. | 252/33 |
| 2,954,342 | 9/1960 | Hotten | 252/32 |
| 3,025,240 | 3/1962 | Sheldahl | 252/33 |
| 3,173,770 | 3/1965 | Thompson et al. | 44/63 |
| 3,326,975 | 6/1967 | Lappin | 260/561 |
| 3,449,097 | 6/1969 | Andress | 44/71 |
| 3,506,712 | 4/1970 | Capowski et al. | 260/567.6 |
| 3,558,630 | 1/1971 | Moyer | 260/561 A |
| 3,799,981 | 3/1974 | Thorpe et al. | 260/562 N |
| 3,909,427 | 9/1975 | Schiff | 252/33 |
| 3,919,094 | 11/1975 | Schiff | 252/33 |
| 3,960,937 | 6/1976 | Schiff | 260/501 |
| 3,965,084 | 6/1976 | Schiff | 260/96.5 R |
| 3,968,151 | 7/1976 | Schiff | 260/501.2 |
| 4,059,535 | 11/1977 | De Vault et al. | 252/33 |

OTHER PUBLICATIONS

*Anionic Surfactants, Part I & II,* p. 446, Warner M. Linfield, Marcel Debber, Inc., New York, New York, 1976.

*Primary Examiner*—Patrick Garvin
*Assistant Examiner*—Raymond K. Covington

[57] ABSTRACT

A detergent additive aminoamide, prepared by reacting a polycarboxylic amino acid with alkylamines, is combined into fuel for an internal combustion engine or lubricating oil as a composition suitable for reducing deposits in an internal combustion engine. In an embodiment of the invention, the aminoamide is further combined with a sulfonic acid to obtain a fuel detergent of improved operability.

5 Claims, No Drawings

AMINOAMIDE FUEL DETERGENTS

BACKGROUND OF THE INVENTION

This invention relates to additives for hydrocarbons suitable for use in an internal combustion engine. In one of its aspects this invention relates to detergent additives for hydrocarbon fuels. In another of its aspects this invention relates to detergent additives for hydrocarbon lubricants. In still another of its aspects this invention relates to the reduction of deposits in an internal combustion engine.

If deposits are allowed to accumulate in an engine they can cause enrichment of the fuel to air ratio which would result in increased hydrocarbon and carbon monoxide emission, reduced fuel economy, and driving problems such as rough idling and frequent stalling. Among the most important considerations of the effects of engine deposits are those having a bearing on the environment. With the advent of pollution standards for automobile exhaust, it has become important that fuel additives not contain phophorus or metal ions which tend to poison the catalysts in automotive engine exhaust converter systems. It is, therefore, of interest to discover new compounds or compositions, which contain no phosphorus or metals, that are useful as detergent additives for fuels and lubricants.

It is therefore an object of this invention to provide compounds that are useful as detergent additives for internal combustion engine fuels and lubricants. It is another object of this invention to provide a method for producing detergent additives. It is still another object of this invention to provide an ashless detergent fuel composition combining an ashless fuel detergent additive with a hydrocarbon suitable for use as fuel in an internal combustion engine. It is still another object of this invention to provide a method for reducing deposits in internal combustion engines.

Other aspects, objects, and the various advantages of this invention will become apparent upon reading the specification and the appended claims.

STATEMENT OF THE INVENTION

According to this invention, a detergent composition is provided in which a fuel for an internal combustion engine or a lubricating oil is combined with an aminoamide. In an embodiment of the invention, the aminoamide is reacted with a sulfonic acid.

The detergent additives of this invention are made by reaction of polycarboxylic amino acids with primary amines to produce aminoamides. The acids have the general formula $R_2N[(CH_2)_aNR]_bR$ where a is 1 to 6, b is zero to 5, and R is $-CH_2COOH$. Suitable examples are N-nitrilotriacetic acid, ethylenediaminetetraacetic acid, diethylenetriaminepentaacetic acid, and the like.

Primary amines used in the synthesis have the formula $R'NH_2$ where R' is a hydrocarbyl radical of about 8–100 carbon atoms, preferably about 12–25 carbon atoms. These hydrocarbyl radicals include alkyl, alkenyl, cycloalkyl, cycloalkenyl, aryl, and combinations such as alkaryl, aralkyl, alkylcycloalkyl, arylcycloalkyl, aralkenyl, and arylcycloalkenyl. Suitable examples are caprylamine, lauryl amine, palmityl amine, oleyl amine; also any isomers or mixtures of isomers of isostearyl amine, phenylstearyl amine, cyclohexylaniline, butylaniline, and the like.

Synthesis of the additives of this invention requires essentially complete amidation of all carboxyl groups on the reactant amino acid(s). Since a mole of water is made for each amide group formed, measurement of water produced in the reaction is a convenient way to follow its progress. The reaction produces a compound of the formula $R''_2N[(CH_2)_aNR'']_bR''$ where a is 1 to 6, b is zero to 5, and R'' is $-CH_2CONHR'$ with R' as defined above.

The reaction is carried out under conditions in which water is removed promptly. Solvents such as liquid hydrocarbons can provide the reaction medium, or the reactants can be combined neat. Suitable hydrocarbon solvents for the reaction are preferably aromatics, but they can be paraffinic or naphthenic. Desirably their boiling range is between 100°–200° C. so the reaction can be conducted under reflux conditions. The temperature for formation of amides lies in the range of about 100°–200° C. As mentioned, evolved water should be removed from the reactor promptly to permit reaction to go to completion. When solvent is used this is done by condensing the refluxing solvent-water mixture and collection of the separated water phase with a Barrett water trap. When no solvent is used, evolved water vapor is swept from the reactor; an inert gas such as nitrogen is suitable for purging the reactor. Although it is not required, use of an inert, oxygen-free gas blanket is recommended during amidation to prevent possible undesirable oxidation reactions. Extent of reaction can be followed by measuring the quantity of water that has been liberated. The additive of this invention requires the production of one mole of water per mole of carboxyl groups in the reactant amino acid(s). Reaction should continue until essentially all of the expected water has been evolved.

When desired, and to improve its water tolerance, the aminoamide additive is reacted with an arylsulfonic acid. Suitable sulfonic acids have the general formula $R'''SO_3H$ where R''' is an aryl or an alkaryl group with 6 to about 100 carbon atoms. Dodecylbenzenesulfonic acid or the acid oil product made by treating lubricating stock with sulfur trioxide are examples of suitable sulfonic acids. The sulfonic acid and aminoamide are reacted by warming the mixture to about 50°–70° C. for 15 to 30 minutes with stirring adequate to produce a homogeneous phase. Viscous reactants are conveniently thinned by dilution with lubircation stock or other hydrocarbon solvents before this neutralization reaction.

These aminoamides, or the product of their reaction with sulfonic acid, are detergent additives which are added to motor fuel in the concentration range about 1–100 lbs/1000 barrels, preferably about 5–30 lbs/1000 barrels, to prevent harmful carburetor and fuel intake system deposits.

These additives are also useful when added to lubricating stock. They serve as detergents to keep the engine parts clean. Other additives, such as viscosity index improvers, antioxidants, and the like, can be used in formulation with the additives of this invention.

The following examples will help to illustrate this invention.

Five preparations containing ethylenediaminetetraacetic acid (EDTA) were made. They contained three different kinds of amines, and varying amounts of sulfonic acid.

Additive 1 was made by reaction of 38.5 gm (0.14 mole) of tallow amine with 10.2 gm (0.035 mole) of ethylenediaminetetraacetic acid (EDTA). The amine, sold by Armak Co. as Armeen T, is made by amination of the fatty acids contained in tallow. The hydrocarbyl portion of the amine ranges from about $C_{14}$ to $C_{18}$, and is distributed approximately 50% paraffinic and 50% olefinic. These materials together with about 100 cc of mixed xylenes were placed in a 250 cc flask fitted with a Barrett water trap and its associated water-cooled condenser to collect evolved water, and a thermometer-containing thermowell, and a magnetic stirrer. The flask was heated, and during about 6 hours of refluxing the theoretical volume (0.14 moles) of water was collected. Solvent was removed by warming the preparation under reduced pressure, leaving a brown, solid product. Then, to 21.2 gm (0.0152 moles) of the tetraamide of EDTA, 9.9 gm (0.0304 moles) of dodecylbenzenesulfonic acid (DBSA) was added to neutralize the two amine nitrogens. The neutralization was effected by combining the components, each dissolved in about 30 cc of toluene, and warming to about 90° C. until all solids were dissolved. Finally, solvent was removed by warming at reduced pressure.

Additive 2 was made by reaction of 75.6 gm (0.36 moles) of coco amine with 26.3 gm (0.09 moles) of EDTA in xylene solution. The amine, sold by Armak Co. as Armeen C, is made by the amination of the fatty acids contained in coconut oil. It contains $C_8$ to $C_{18}$ chains that are mostly paraffinic. Reaction conditions were essentially identical to those detailed for Additive 1. After 4 hours of reflux the theoretical quantity (0.36 moles) of water had been collected. Half of the resulting tetraamide (0.045 moles) was combined with 29.3 gm (0.09 moles) of dodecylbenzenesulfonic acid in about 200 cc of xylene solution. After warming to complete the neutralization, and to dissolve the acid, solvent was removed by evaporation.

Additive 3 was made by reaction of 138.8 gm (0.4 moles) of phenylstearyl amine with 29.2 gm (0.1 moles) of EDTA. The amine is sold by Armak Co. as Armeen LP-S. Again using xylene solvent, and reaction conditions essentially identical to those for Additive 1, the theoretical quantity (0.4 moles) of water was collected after about 6 hours of refluxing. The quantity of xylene was that which required a reactor temperature of 155°-160° C. to maintain reflux. This preparation was divided into three equal parts. Solvent was removed from one part by warming at 90° C., 25 mm mercury pressure.

Additive 4 was made by adding to a one-third aliquot from Additive 3 an equi-molar mass (9.6 gm) of dodecylbenzenesulfonic acid. After warming to complete reaction, solvent was removed at the same conditions cited for Additive 3.

Additive 5 was made by adding to the remaining one-third aliquot from Additive 3 twice the equi-molar mass (19.2 gm) of dodecylbenzenesulfonic acid. Preparation and solvent removal were identical to those used for Additive 4.

Five preparations containing N-nitrilotriacetic acid (NTA) were made. They contained two different amines; only one preparation was quaternized with sulfonic acid.

Additive 6 was made by reaction of 83.3 gm (0.24 moles) of phenylstearyl amine with 15.3 gm (0.08 moles) of NTA in about 80 cc of xylenes. Experimental arrangement and conditions were essentially the same as stated for Additive 1. The theoretical volume of water (0.24 moles) was collected in 3.5 hrs while refluxing at 150° C. reactor temperature. This solution of triamide was divided into two equal parts. The solvent was removed from one part at reduced pressure on a rotary evaporator.

Additive 7 consisted of reacting the remaining half of Additive 6 with 12.4 gm (0.038 moles) of dodecylbenzenesulfonic acid. Solvent was removed from the product by warming at reduced pressure in a rotary evaporator, and the residue was reserved for testing.

Additive 8 was made by reaction of 30.0 gm (0.08 moles) of phenylstearylamine and 10.7 gm (0.04 moles) of oleyl amine with 7.6 gm (0.04 moles) of NTA. Both amines are sold by Armak Co.—the former as Armeen LP-S and the latter as Armeen OD. Reactants were combined by adding the NTA to a stirred solution of the amines in toluene. Refluxing at a reactor temperature of 190°-195° C. produced the theoretical volume of water (0.12 moles) in two hours. Solvent was removed from the preparation by heating at 110° C., 1 mm Hg pressure, for about two hours.

Additive 9 was made by reaction of 27.1 gm (0.10 moles) of oleyl amine and 17.4 gm (0.05 moles) of phenylstearyl amine with 9.6 gm (0.05 moles) of NTA in a manner essentially identical to Additive 8. The theoretical volume of water (0.15 moles) was collected during 6 hours of refluxing at 150°-190° C. Solvent was removed as for Additive 8.

Additive 10 was made by reacting 138.2 gm (0.51 moles) of oleyl amine and 32.5 gm (0.17 moles) of NTA in about 100 cc xylenes. Because this system has pronounced foaming tendency a 2-liter flask, fitted with a Barrett water trap and associated water-cooled condenser, and stirred with a magnetic stirrer, was used. Despite the large reactor volume a part of the mixture was lost via the condenser by foaming while refluxing at 130° to 200° C. Hence, the volume of recovered water was only about 89% of the theoretical volume, but it is believed that the amidation went to completion. Refluxing was stopped four hours after water removal had ceased; solvent was removed from the product in a rotary evaporator.

TESTS OF ADDITIVES

Additives whose preparation is described as Additives 1-10 were subjected to a series of tests in gasoline, at the concentrations listed.

1. Falcon engine test. 10 lbs/1000 barrels.
2. Thin layer chromatography (TLC) test, for detergency. 7.63 wt. percent additive.
3. Spray gum deposit. 0.10 wt. percent additive.
4. Water tolerance test. Twice the concentration used in Falcon engine test.

The Falcon engine test, briefly, involves use of the test gasoline in a 170 cubic inch displacement 6-cylinder automobile engine with a removable carburetor throat insert. The engine operated for 23 hours at 1800 rpm and 11.4 brake horsepower. The difference in insert weight before and after the test corresponds to the weight of deposits. Results are compared with tests using a base gasoline which was commercial leaded gasoline.

The TLC test for detergency provides a basis for evaluating potential carburetor detergents in a much shorter period of time than the Falcon engine test requires. It involves use of a toluene solution of the additive being tested to move a small portion of carburetor deposit in a developing paper chromatogram. Results are reported as follows:

| Numerically | Verbally | Description |
|---|---|---|
| 4 | Poor | Deposit remains with no or very little movement. |
| 6 | Fair | About half of deposit is removed and carried upwards, possible streaking full length of solvent movement. |
| 8 | Good | Much of deposit moves with solvent front, or close to it; only a small part of it remains at origin. |
| 9 | Good | Deposit is completely moved, and essentially moves with solvent front. |
| | Excellent | |

This test was developed to screen additives without using the time that engine tests require. Additives that fail this test always fail the engine test, but those that pass it should be confirmed by engine test data. A rating of 4 is considered to be a failure.

The spray gum deposit test provides a measure of the thermal stability of the additive being evaluated. The test is carried out by spraying 250 cc of gasoline containing the additive and 0.04 wt. percent Santolube 395-X (a sulfurized terpene, to augment gum formation) into a tared aluminum pan maintained at 191° C. After spraying has ended, the pan is cooled, washed in n-heptane, dried, and reweighed. Test results are reported as the gain in weight, in milligrams, per 250 cc gasoline.

The water tolerance test measures the propensity of the additive-gasoline solution to form undesirable aqueous emulsions. The test measures the amount of demulsifier which must be added to the additive-fuel blend to break the emulsions. The demulsifier used is Oronite OGA-473. Samples are tested by the ASTM standard test method "Water Reaction of Aviation Fuels" (ASTM D-1094-72) and the results are reported as the percent of demulsifier (based on the amount of additive present) required to give a 1 or 1b (pass) rating. Additives which require low percentages of demulsifier are considered to have superior water tolerance characteristics and those requiring more than 4 percent demulsifier fail the test.

Results of tests on the additives are summarized in the following tabulation:

| Additive No. | Composition (molar ratios) | Falcon engine* | TLC | Spray gum | Water tolerance |
|---|---|---|---|---|---|
| 1 | 4 Tallowamine: EDTA:2DBSA | 63 | 8 | 0.1 | 1 |
| 2 | 4 Cocoamine: EDTA:2DBSA | 47 | 8 | 0.1 | 1 |
| 3 | 4 Phenylstearyl amine:EDTA | 51 | 8 | 0.0 | 1 |
| 4 | 4 Phenylstearyl amine: EDTA:DBSA | 62 | 8 | 0.0 | 1 |
| 5 | 4 Phenylstearyl amine: EDTA:2DBSA | 53 | 7 | 0.1 | 1 |
| 6 | 3 Phenylstearyl amine: NTA | 41 | 8 | 0.0 | 1 |
| 7 | 3 Phenylstearyl amine: NTA:DBSA | 50 | 7 | 0.0 | 1 |
| 8 | oleyl amine:2 phenylstearyl amine:NTA | 67 | 7 | 0.0 | 0 |
| 9 | 2 oleyl amine:phenylstearyl amine:NTA | 47 | 7 | 0.0 | 0 |
| 10 | 3 oleyl amine:NTA | 68 | 7 | 0.0 | 1 |

*Percent reduction in unwashed carburetor deposits relative to base fuel without additive.

Additives whose preparation has been described illustrate a number of aspects of this invention. Numbers 1, 2, and 5 are amides from different amines reacted with EDTA and have their amino nitrogen completely sulfonated. Additives 3 and 4 are similar to 5, but with no or half sulfonation. Additive 7 is analogous to 1, 2, and 5, but is based on NTA. Additives 6,8–10 illustrate the equivalence of oleyl and phenylstearyl amines.

Their evaluation by the TLC screening test showed them to have good detergency; the Falcon engine test demonstrated that they reduce carburetor deposits. All additives performed very well in both the spray gum and water tolerance tests.

We claim:

1. A method for reducing engine deposits in an internal combustion engine comprising the addition to the hydrocarbon fuel for the engine of a detergent fuel additive that is the reaction product of an aminoamide of the formula $$R''_2N[(CH_2)_aNR'']_bR''$$

where a is 1 to 6, b is zero to 5, and R'' is $CH_2CONHR'$ with R' a hydrocarbyl radical of about 8–100 carbon atoms and a sulfonic acid having the formula $R'''SO_3H$ where R''' is chosen from among an aryl and an alkaryl group with 6 to about 100 carbon atoms said ashless fuel detergent being added in an amount effective to reduce engine deposits and using said hydrocarbon fuel with ashless fuel detergent additive as fuel in an internal combustion engine.

2. The method of claim 1 wherein the ashless fuel detergent is present in an amount in the range of about 1–100 lbs/1000 barrels of hydrocarbon fuel.

3. A method according to claim 1 wherein b is zero.

4. A method according to claim 1 wherein b is 2 to 5.

5. A method according to claim 3 wherein said aminoamide is the reaction product of n-Nitrilotriacetic acid and an amine chosen from among the group consisting of phenylstearyl amine and oleyl amine.

* * * * *